US008511110B2

(12) United States Patent
Kim

(10) Patent No.: US 8,511,110 B2
(45) Date of Patent: Aug. 20, 2013

(54) BEVERAGE COOLER WITH HIDDEN COOLING CONTAINER AND TABLE TOP

(75) Inventor: Byung-Chul Kim, Ulsan (KR)

(73) Assignee: Byung-Chul Kim, Ulsan (KR)

( * ) Notice: Subject to any disclaimer, the term of this patent is extended or adjusted under 35 U.S.C. 154(b) by 1332 days.

(21) Appl. No.: 11/718,180

(22) PCT Filed: Oct. 29, 2005

(86) PCT No.: PCT/KR2005/003628

§ 371 (c)(1),
(2), (4) Date: Oct. 27, 2008

(87) PCT Pub. No.: WO2006/046844

PCT Pub. Date: May 4, 2006

(65) Prior Publication Data

US 2009/0229293 A1 Sep. 17, 2009

(30) Foreign Application Priority Data

Oct. 29, 2004 (KR) ..... 10-2004-0087053

(51) Int. Cl.
*F25D 3/08* (2006.01)

(52) U.S. Cl.
USPC ..... 62/457.4; 62/426; 62/457.1; 62/457.5; 62/446

(58) Field of Classification Search
USPC ..... 62/457.4, 426, 457.1, 457.5, 446
See application file for complete search history.

(56) References Cited

U.S. PATENT DOCUMENTS 5,415,010 A * 5/1995 Woo ..... 62/258
2004/0118141 A1* 6/2004 Kim et al. ..... 62/258

FOREIGN PATENT DOCUMENTS

JP 07148026 6/1995
KR 20035782 1/2003

* cited by examiner

*Primary Examiner* — Cheryl J Tyler
*Assistant Examiner* — Jonathan Koagel
(74) *Attorney, Agent, or Firm* — Sughrue Mion, PLLC

(57) ABSTRACT

Disclosed herein is a cooler of table-type, which can be easily kept in custody and reduce power consumption, and which can increase a cooling efficiency and provide a visual satisfaction to a user. The cooler of table-type includes: a chilling room formed at the center of a table, opened at the top and closed at the inner periphery and the bottom; a cooling container adapted to vertically elevate in a state where it is in tight contact with the inner periphery of the chilling room and adapted to contain foods therein; a cooling pole vertically mounted on the bottom of the cooling container and adapted to form ice on the surface thereof; a mushroom type shade mounted on the top of the cooling pole for cove ring the upper end of the chilling room when it is descended, the shade having a predetermined thickness; cooling coils arranged inside and outside the cooling container, the cooling pole and the shade for circulating refrigerant; a cooler for thermally exchanging the refrigerant by circulating the refrigerant through the cooling coils and repeating condensation and expansion; an elevator for vertically elevating the cooling container; and a drain pipe mounted downwardly from the bottom of the cooling container.

21 Claims, 8 Drawing Sheets

BEVERAGE COOLER WITH HIDDEN COOLING CONTAINER AND TABLE TOP

CROSS REFERENCE

To Related Applications This application is the National Phase entry of PCT/KR2005/003628 filed Oct. 29, 2005, which claims priority to Korean Application No. 10-2004-0087053 filed Oct. 29, 2004. The contents of this application is hereby incorporated herein by reference.

TECHNICAL FIELD

The present invention relates to a cooler of table-type, and more particularly, to a cooler of table-type, which can be easily kept in custody and can reduce power consumption since a chilling room is contained inside a table and a cooling container for putting food containers thereon is elevated inside the chilling room, and which can increase a cooling efficiency and provide a visual satisfaction to a user by a cooling pole mounted at the center of the cooling container and having a shade formed at the center of the cooling pole.

BACKGROUND ART

In general, beer or beverage contained in a can or a bottle provides the best taste at a low temperature. However, as time goes after beer and beverage is took out of a refrigerator, the temperature rises and the beer or beverage becomes untasty.

To solve the above problem, Korean Patent Application No. 10-2001-0002797 (applied by Kim Byung Cheol, and Ha Sang Min, and entitled "multipurpose cooler", hereinafter called "table cooler") discloses a cooler in which a refrigerator and a table are combined.

Such table cooler is installed in beer bars, restaurants, hotels, outdoor party places, high-level houses, so that the table cooler provides excellent interior effect. Such table cooler allows users to select and drink wanted alcoholic liquors or beverage in a state where they sit around the table cooler without necessity to move from a refrigerator to a table and put a beverage container into cooled water or ice contained inside the table cooler, whereby the alcoholic liquors or beverage can continuously keep the cooled state even though time goes by.

The conventional table cooler includes a wide cooling container mounted at the center of a table for containing a beer container or a beverage container together with water or ice, cooling coil arranged outside the cooling container in a zigzag form for always keeping the contained beer or beverage in a low temperature, a drain pipe mounted on the bottom of the cooling container and extending to a pouring basin located on the bottom of the table for easily discharging water contained in the cooling container or wash water used for washing.

DISCLOSURE OF INVENTION

Technical Problem

In the conventional table cooler, since the upper portion of the cooling container is always opened, the cold air is exhausted to the outside or the temperature of the cooling container rises by the surrounding temperature of the cooling container, and so, ice contained in the cooling container is melted or the temperature of cooling water is increased. To prevent melting of ice or rise of the temperature of the cooled water, since the cooler is continuously operated, power consumption is excessively increased and noise is generated by the operation of the cooler.

Furthermore, since the conventional table cooler does not have an illuminating system, it needs the outside illumination for illuminating the beer container or the beverage container contained in the cooling container. Additionally, a lamp must be installed in the case where the table cooler is used outdoors at night, and it is difficult to concentrate illumination to the table cooler.

Moreover, the conventional table cooler has further problem in that the cooling efficiency is lowered since the cooling container is cooled only by thermal conduction.

Additionally, in the conventional table cooler, since the center of the table is opened and the beer container or the beverage container is projected to the outside of the table, it cannot be used as a table for other use purposes, for example, for a meal, for discussion or other purposes.

Technical Solution

Accordingly, it is an object of the present invention to provide a cooler of table-type, which can reduce power consumption when it is kept in custody, provide more bright illumination by providing self-illumination outdoors and concentrating illumination to the cooler, increase a cooling efficiency, and be used not only for the cooling but also for various use purposes.

To achieve the above object, the present invention provides a cooler of table-type comprising: a chilling room formed at the center of a table, opened at the top and closed at the inner periphery and the bottom; a cooling container adapted to vertically elevate in a state where it is in tight contact with the inner periphery of the chilling room and adapted to contain foods such as fruits, beverage and alcoholic liquors therein;

a cooling pole vertically mounted on the bottom of the cooling container and adapted to form ice on the surface thereof; a mushroom type shade mounted on the top of the cooling pole and covering the upper end of the chilling room when it is descended, the shade having a predetermined thickness; cooling coils arranged inside and outside the cooling container, the cooling pole and the shade for circulating refrigerant; a cooler for thermally exchanging the refrigerant by circulating the refrigerant through the cooling coils and repeating condensation and expansion; an elevator for vertically elevating the cooling container; and a drain pipe mounted downwardly from the bottom of the cooling container.

Furthermore, the cooler of table-type further comprises a fan, an illumination system, or a fog discharge device (humidifier) mounted in a space formed inside the shade.

Moreover, the cooler of table-type further comprises opening and closing means which covers the upper surface of the shade covering the top of the chilling room and keeps the same height as the upper surface of the table when it is descended, whereby a user can use it as a general table which has an even upper surface.

The chilling room can be in the form of a hexagon, cylinder or trigonal prism according to the shape of the table, is opened at the top, and closed at the inner periphery and the bottom thereof in order to prevent discharge of the cold air.

The cooling container having the cooling pole and the shade formed on the top thereof is in the same from as the chilling room, and vertically elevates inside the chilling room. The cooling container includes the opened upper surface, and the inner wall and the lower surface having a predetermined height, and stores a beverage container, alcoholic liquor container or foods in a refrigerating state or a fresh state. The inside of the cooling container is empty or filled with water or ice to increase the cooling efficiency.

The shade has the same outward appearance as the chilling room, so that it can close the upper surface of the chilling room when the cooling container is descended. The inside of the shade is filled with something or has a space.

The cooling coil (cooling pipe) arranged in the cooling container is arranged at the bottom and the outer wall of the cooling container for cooling the cooling container. The cooling coil arranged in the cooling pole is in a spiral form in such a way as to be in tight contact with the inner periphery of the cooling pole. In the case where the cooling coil is arranged in the shade having the space, the cooling coil is in tight contact with the lower surface of the shade. At this time, to prevent that the cooling coil is in direct contact with the outside air, the cooling coil is surrounded with urethane foam at the lower surface or the outer wall surface of the cooling container, at the inner periphery of the cooling pole, and at the lower surface of the shade.

The elevator is a device mounted on the lower surface of the chilling room for vertically elevating the cooling container, but it is preferable to use a telescopic cylinder, a pantograph jack or a gearing device (rack and pinion) in order to properly use the space.

Furthermore, the drain pipe is mounted to discharge water formed by melting ice inserted into the cooling container, cooling water or wash water for washing the inside of the cooling container to the outside. The drain pipe has a side mounted at the lower surface of the cooling container, and the other side mounted at a predetermined portion of the side surface of the table for allowing smooth water drainage. The drain pipe can be expanded or shrunk according to the elevation of the cooling container.

Moreover, the cooler for thermal exchanging of the refrigerant circulating inside the cooling coils is positioned inside a receiving room formed in the lower portion of the cooling container, and so, elevated according to the elevation of the cooling container, thereby allowing a smooth circulation of the refrigerant even though unexpanded cooling coil is used.

Additionally, the fan mounted inside the shade is to downwardly discharge fogs generated from a fog discharging device and the cold air generated from the cooling coil, an illuminating system is to downwardly emit light of various colors. At least one grill is formed on the lower surface of the shade for allowing the discharge of the fogs and the cold air and the illumination.

Meanwhile, it is preferable that the opening and closing means for enabling the user to use the cooler of table-type as a dinner table or a general table by making the entire upper surface of the table even adopts a sliding manner in order to open and close the upper surface of the shade.

Advantageous Effects

As described above, the present invention can considerably reduce power consumption during cooling since the cooling container is descended into the chilling room to be cold-stored in the chilling room in a sealable state. Furthermore, the present invention includes the illuminating system mounted inside the shade, thereby easily providing illumination outdoors and enabling the user to use the cooling container in a more bright condition by concentrating illumination to the cooling container. Moreover, the present invention can increase a cooling efficiency by lowering the cold air discharge speed by the air curtain formed between the shade and the cooling container by the cold air discharge fan. Additionally, the air curtain provides a cooling effect by lowering the temperature around the table. Furthermore, the present invention can be used as a general table if the user does not want to eat or drink foods or beverage, whereby the present invention can be used as a multipurpose table and reduce the occupied space. Moreover, the present invention can be used for cooling foods and allowing the user to immediately eat the cooled foods and serves as a refrigerator.

EXPLANATION OF ESSENTIAL REFERENCE NUMERALS IN DRAWINGS

Figure 1:
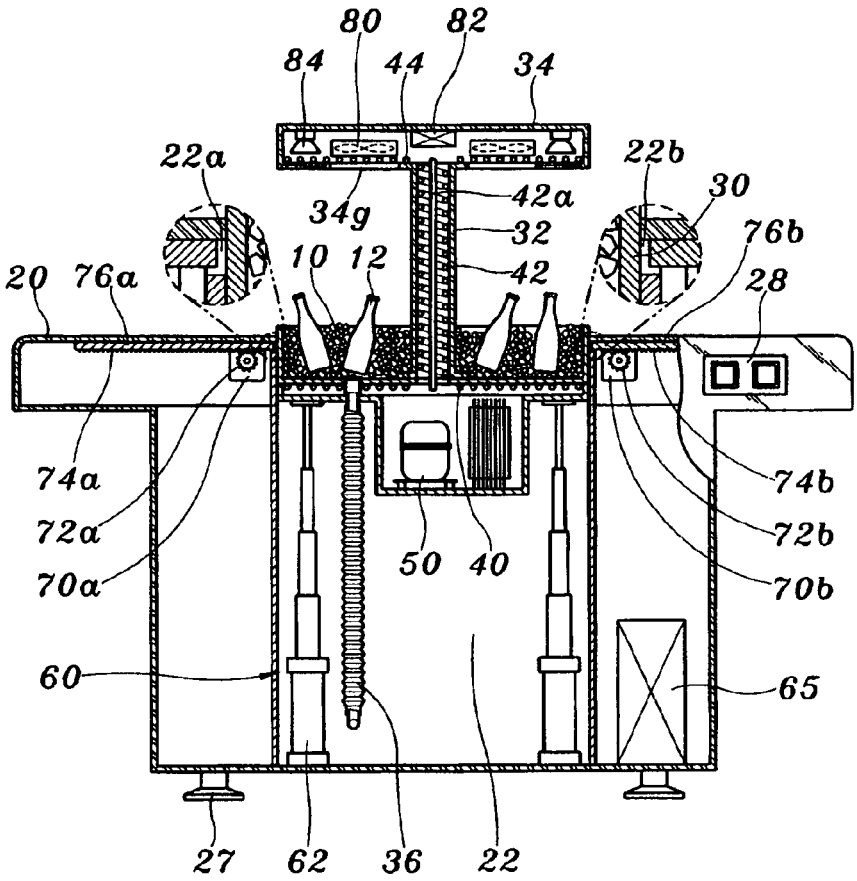
FIG. 1 is a sectional view of a cooler of table-type according to the present invention.

20: table 22: chilling room
22*a*,22*b*: door entrance 30: cooling container
32: cooling pole 34: shade
34*g*: grill 36: drain pipe
38: auxiliary plate 40,42,44: cooling coil
42*a*,42*b*: return pipe 50: cooler
60: elevator 62: cylinder
70*a*,70*b*: opening and closing motor
72*a*,72*b*: pinion 74*a*,74*b*: rack
76*a*,76*b*: sliding door 80: cold air discharge fan
82: humidifier 84: lamp
90: pantograph jack 91*a*,91*b*: pivot nut
92: lead screw 94: elevation motor

MODE FOR THE INVENTION

Reference will now be made in detail to the preferred embodiments of the present invention, examples of which are illustrated in the accompanying drawings.

In the drawings, a cooling container 30 is filled with ice cubes, but it would be appreciated that the cooling container 30 may be empty or filled with water.

As shown in FIGS. 1 to 9, a cooler of table-type according to the present invention includes: a table 20 having a chilling room 22 opened at the top and closed at the inner periphery and the bottom; a cooling container 30 vertically elevating in a state where it is in tight contact with the inner periphery of the chilling room 22 and containing foods such as fruits, beverage and alcoholic liquors therein; a cooling pole 32 vertically mounted on the bottom of the cooling container 30 and forming ice on the surface thereof; a mushroom type shade 34 mounted on the top of the cooling pole 32 for covering the top of the chilling room 22 when it is descended; cooling coils 40, 42 and 44 arranged inside the cooling container 30, the cooling pole 32 and the shade 34 for cooling them; a cooler 50 for thermally exchanging refrigerant by circulating the refrigerant through the cooling coils 40, 42 and 44 and repeating condensation and expansion; an elevator 60 for vertically elevating the cooling container 30; and a drain pipe 36 mounted downwardly from the bottom of the cooling container 30.

Here, a part of the drain pipe 36 is a bellows type which is expanded during the elevation, and penetrates the side surface of the table 20 through an elbow so as to drain water.

Furthermore, opening and closing means includes sliding doors 76*a* and 76*b* for opening and closing the chilling room 22, thereby enhancing sealability of the chilling room 22. The sliding doors 76*a* and 76*b* horizontally move by pinions 72*a* and 72*b* and racks 74*a* and 74*b* driven by opening and closing motors 70*a* and 70*b*, and move into and out of the chilling room 22 through slit type door entrances 22*a* and 22*b* formed at the right and left sides of the top of the inner wall of the chilling room 22.

Figure 5:
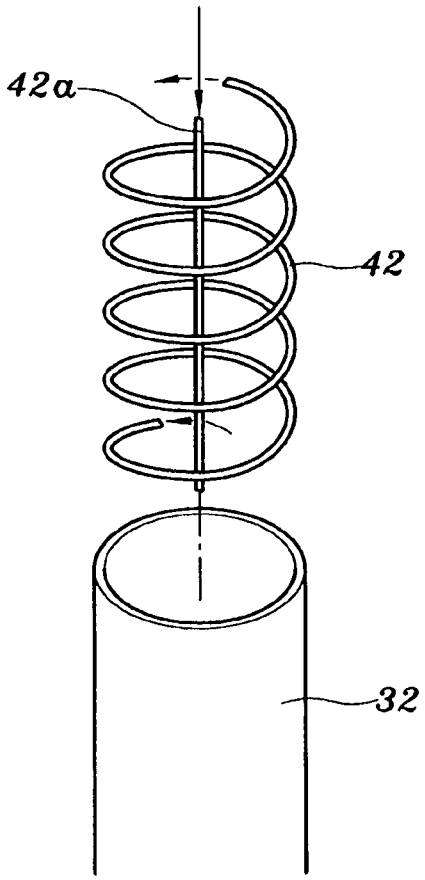
FIG. 5 is an exploded perspective view showing an example of a cooling coil arranged inside a cooling pole according to the present invention.
Figure 6:
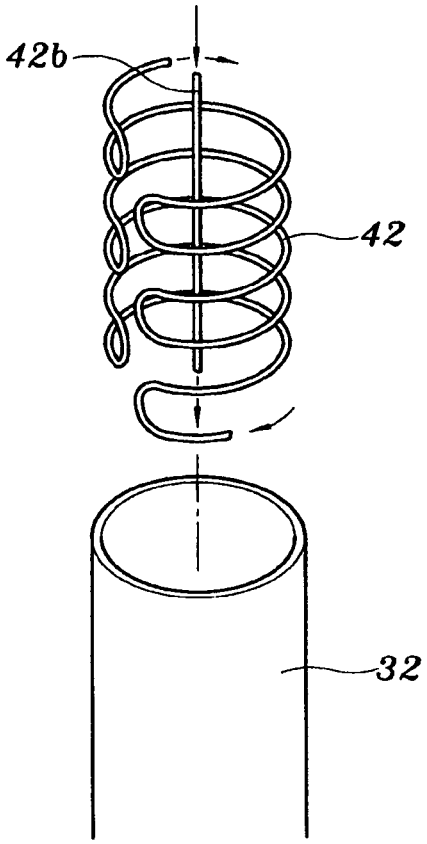
FIG. 6 is an exploded perspective view showing another example of a cooling coil arranged inside a cooling pole according to the present invention.

As shown in FIG. 5, the cooling coil 42 is arranged on the inner periphery of the cooling pole 32 in a coil form, and has a return pipe 42*a* mounted at the center thereof for returning the refrigerant. As another example, as shown in FIG. 6, the cooling coil 42 may be bent in a zigzag form and rolled in an arc shape. After that, the rolled cooling coil 42 is in tight contact with the inner periphery of the cooling pole 32, and has a return pipe 42*b* mounted at the center thereof for returning the refrigerant.

A grill 34*g* is formed on the lower surface of the shade 34, and a cold air discharge fan 80 for forming an air curtain by discharging the cold air to the cooling container 30 through the grill 34*g* is mounted. Meanwhile, a humidifier 82 for discharging fogs by the cold air discharge fan 80 is mounted inside the shade 34 in order to generate fogs. A lamp 84 is mounted inside the shade 34 in order to provide an illumination function. Moreover, if the lamp 84 of various colors is mounted, a more gorgeous atmosphere can be produced.

Figure 7:
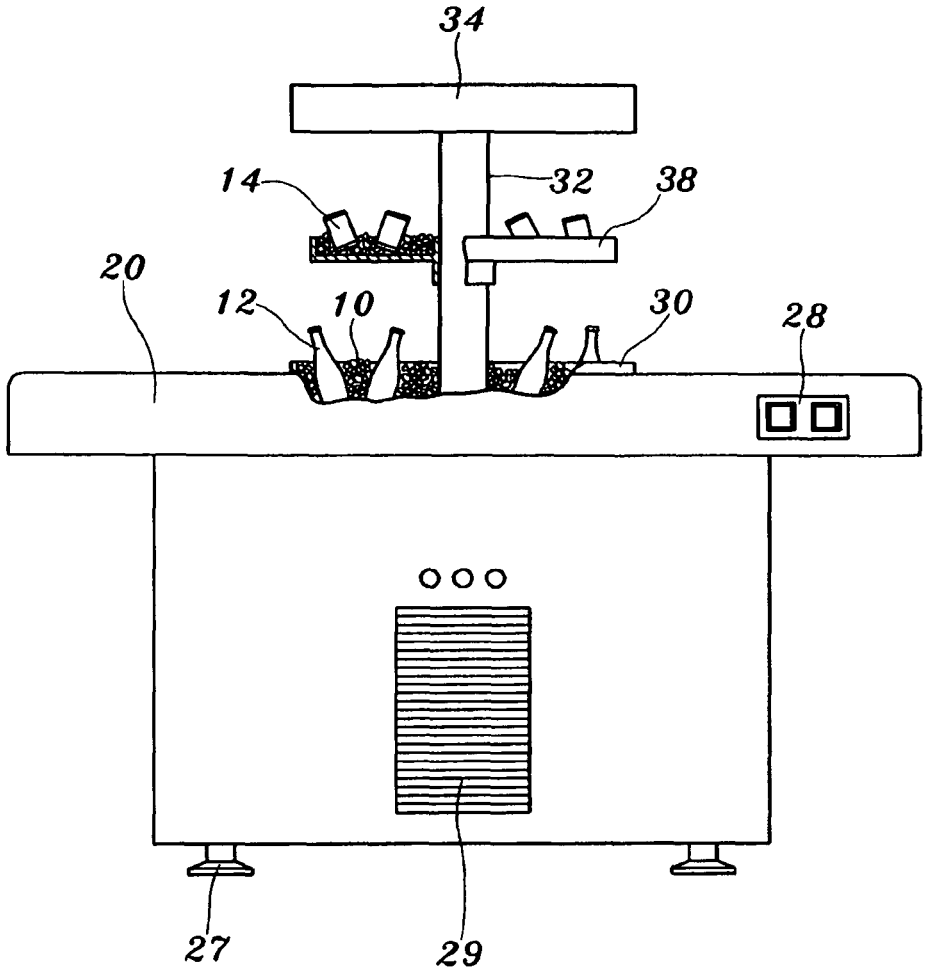
FIG. 7 is a partially sectional view showing an example that an auxiliary plate is mounted on the cooling pole according to the present invention.

As shown in FIG. 7, an auxiliary plate 38 is mounted at the center of the cooling pole 32 so that ice 10, alcoholic liquor container 12 or a beverage container 14 can be put thereon. In the drawing, one auxiliary plate 38 is mounted on the cooling pole 32, but it would be appreciated that a number of auxiliary plates 38 can be mounted on the cooling pole 32 in a multilayer structure. A cooling coil (not shown) and a drain pipe (not shown) may be mounted on the auxiliary plate 38 for smooth cooling and drainage.

Additionally, the auxiliary plate 38 is made of a transparent material in such a way that light emitted from the lamp 84 mounted inside the shade 34 can be permeated through the auxiliary plate 38 toward the cooling container 30 mounted under the shade 34.

As shown in FIGS. 1 to 4, for example, the elevator 60 is vertically mounted between the bottom of the cooling container 30 and the table 20, and includes a telescopic cylinder 62 for elevating the cooling container 30 by expansion and shrinkage.

Figure 8:
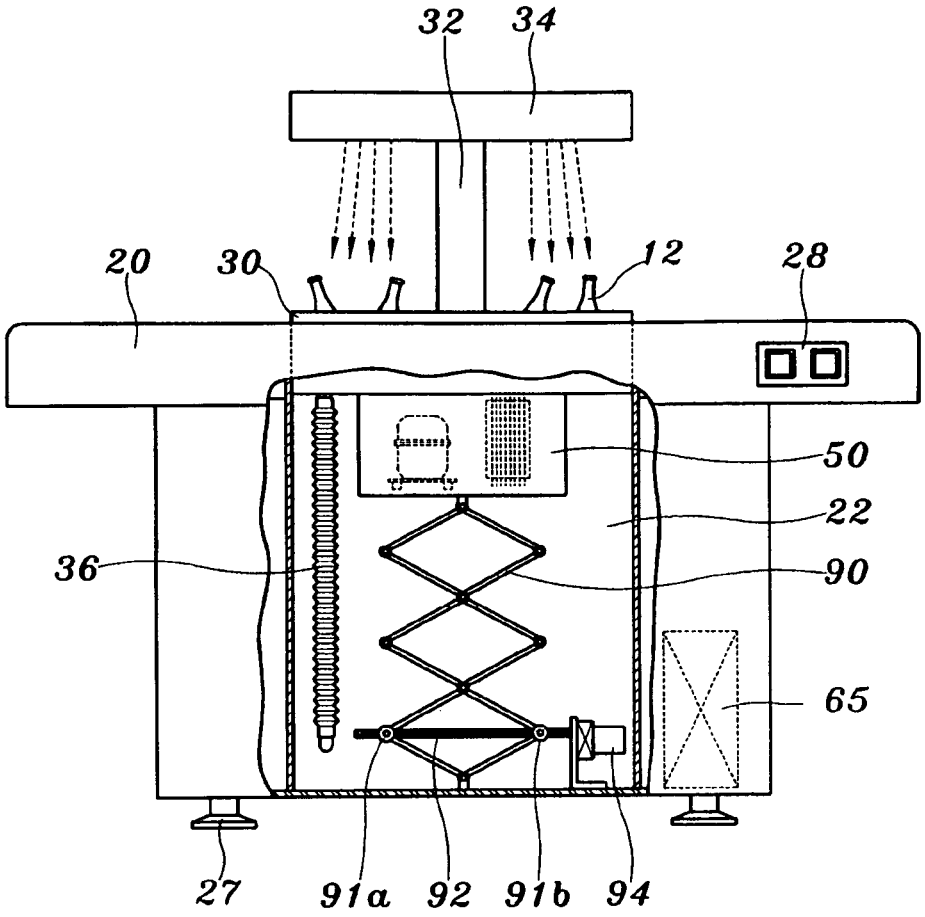
FIG. 8 is a partially sectional view showing another example of an elevator according to the present invention.
Figure 9:
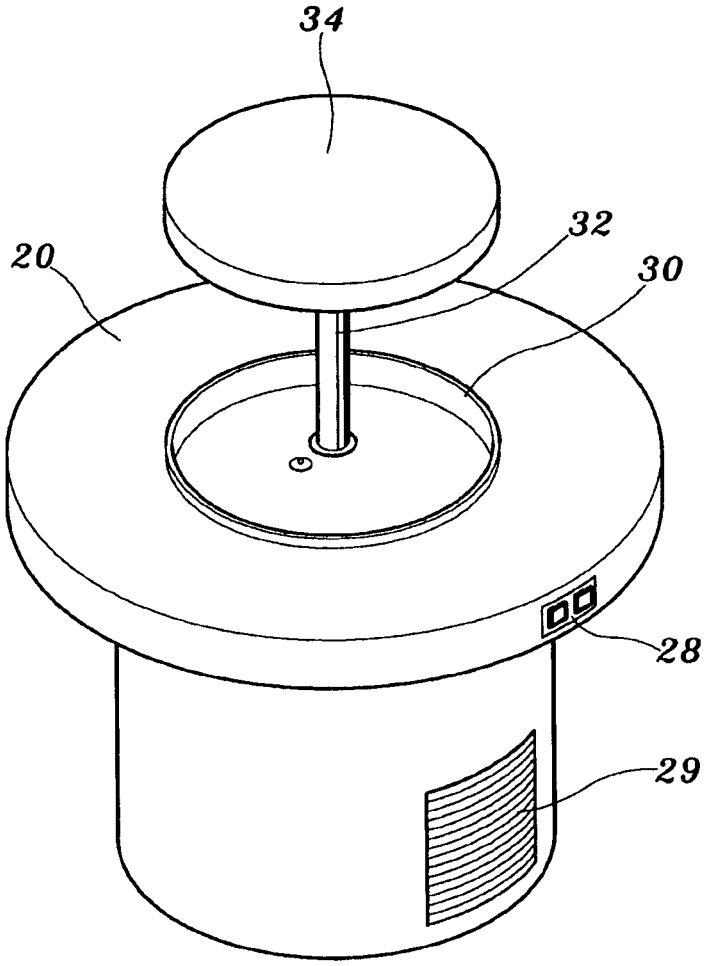
FIG. 9 is a perspective view showing an example of a rounded cooler of table-type according to the present invention.

As shown in FIG. 8, the elevator 60 includes: a pantograph jack 90 for connecting the cooling container 30 and the table 20 with each other; pivot nuts 91*a* and 91*b* mounted at right and left sides of a linking part of the pantograph jack 90 and respectively having screw threads formed in opposite directions to each other; a lead screw 92 screwed to the pivot nuts 91*a* and 91*b* for vertically expanding and shrinking the pantograph jack 90; and an elevation motor 94 connected to a side end of the lead screw 92 for rotating the lead screw 92.

In the drawing, the unexplained reference numeral 28 designates a switch panel having an ascent switch and a descent switch, the reference numeral 65 designates a driving source such as a compressor or a hydraulic unit for driving the telescopic cylinder 62, the reference numeral 27 designates a bridge for supporting the table 20, and the reference numeral 29 designates a radiation grill formed on the wall surface of the table.

Hereinafter, referring to the drawings, the operation of the present invention will be described in detail as follows.

As shown in FIGS. 1 to 9, when a user presses the ascent switch of the switch panel 28 in a state where the cooling container 30 is contained inside the chilling room 22 of the table 20, the cooling container 30 rises upwardly from the chilling room 22 by the elevator 60, and stops at a height nearly equal to the upper surface of the table 20.

Figure 2:
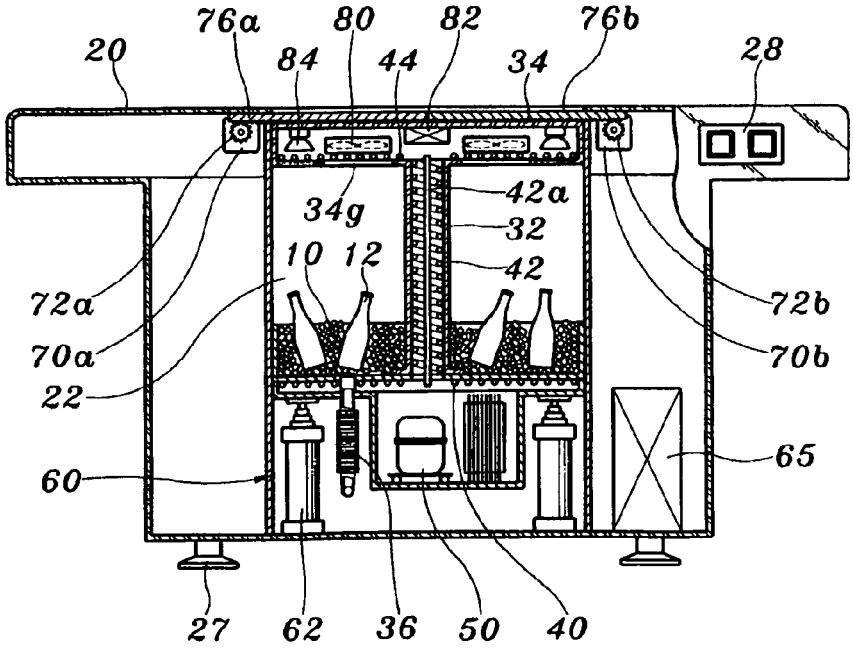
FIG. 2 is a sectional view showing a state where the cooler is descended.
Figure 3:
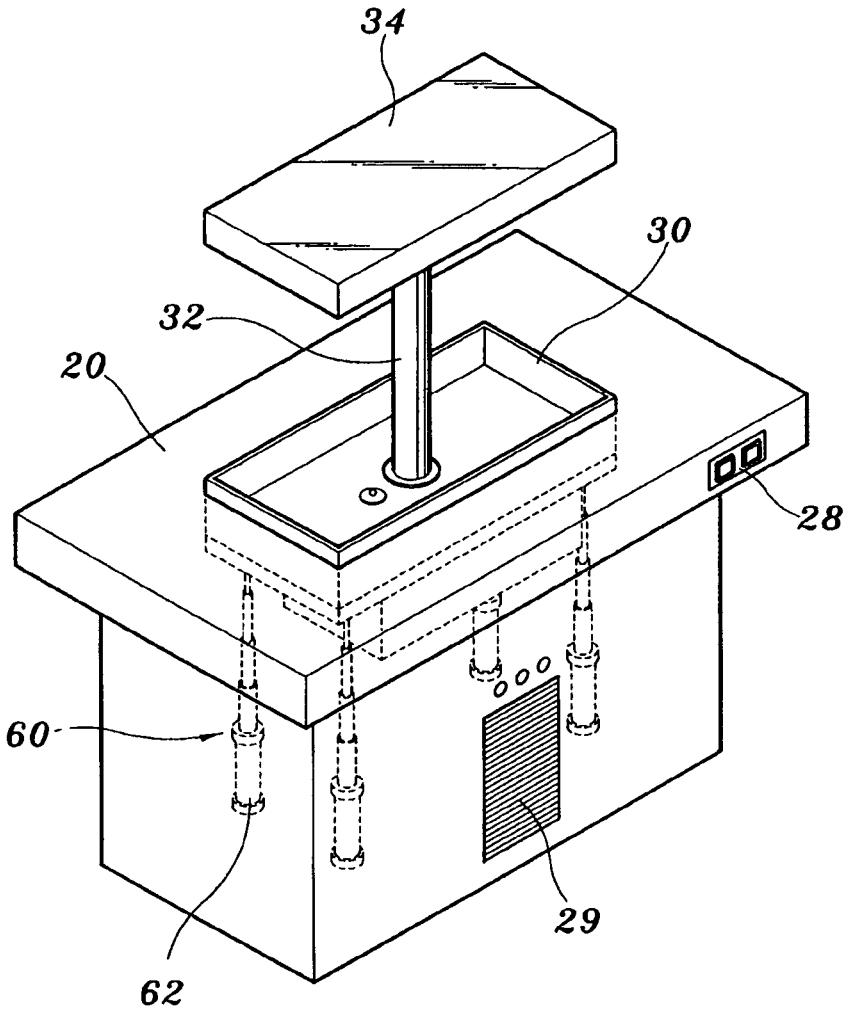
FIG. 3 is a perspective view of the cooler of table-type according to the present invention.
Figure 4:
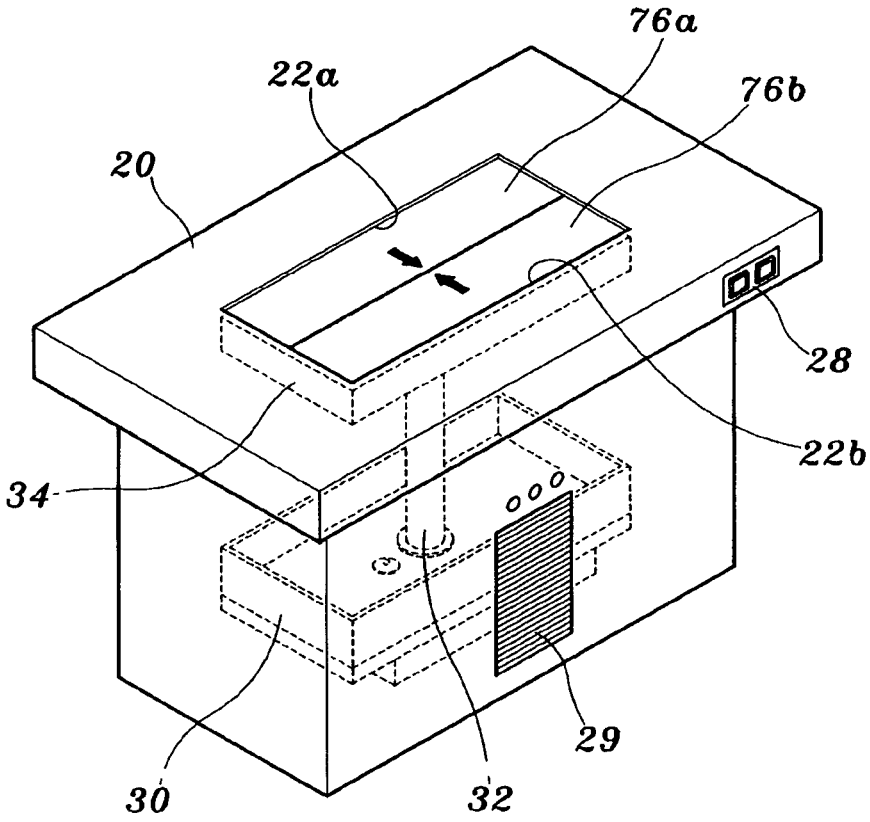
FIG. 4 is a perspective view showing the state where the cooler is descended.

At this time, as shown in FIGS. 1 to 3, in the case where the elevator 60 includes the telescopic cylinder 62, since a piston rod is telescopic even though a cylinder tube is short, the elevator 60 is expanded several times longer than the cylinder tube in such a way as to enlarge a stroke distance in a restricted height. When the piston rod is expanded, the cylinder tube is fixed at the bottom of the table 20, and the piston rod lifts the cooler 50 and the cooling container 30 upwardly.

Furthermore, as shown in FIG. 8, in the case where the elevator 60 includes the pantograph jack 90, when the lead screw 92 is rotated forwardly by the elevation motor 94, the pivot nut 91*a* of a left-hand screw type and the pivot nut 91*b* of a right-hand screw type which are screwed to the lead screw 92 are moved in the opposite directions, and then, the central top of the pantograph jack 90 is expanded upwardly so as to ascend the cooler 50 and the cooling container 30.

Meanwhile, when the cooling container 30 is ascended, the cooling pole 32 vertically standing on the cooling container 30 and the shade 34 mounted on the top of the cooling pole 32 are also ascended together with the cooling container 30, whereby the cooling pole 32 and the shade 34 are projected upwardly, and the ice 10, the alcoholic liquor container 12 and the beverage container 14 contained in the cooling container 30 are exposed upwardly from the table 20.

After that, when the cold air discharge fan 80 and the humidifier 82 are operated, moisture generated from the humidifier 82 is rapidly cooled in a frost form, and discharged downwardly through the grill 34*g* formed on the bottom surface of the shade 34 by the cold air discharge fan 80, whereby the alcoholic liquor container 12 and the beverage container 14 put in the cooling container 30 is cooled more, it is prevented that the ice 10 filling the cooling container 30 is melted, and the user can obtain a visual satisfaction.

In addition, when the cold air is discharged from the cold air discharge fan 80 through the grill 34*g*, the air curtain is formed between the shade 34 and the cooling container 30. The air curtain is to increase a cooling efficiency by lowering the speed that the cold air is exhausted to the outside, and lowers the temperature around the table 20, thereby increasing a cooling effect.

Furthermore, the refrigerant circulating along the cooling coils 40, 42 and 44 by the cooler 50 cools the cooling container 30, the cooling pole 32 and the shade 34, so that the ice 10, the alcoholic liquor container 12 and the beverage container 14 can be kept in a low temperature, and the user can set the temperature as the user wants. The refrigerant flowing into the shade 34 is returned to the cooler 50 through the return pipes 42*a* and 42*b* mounted at the center of the cooling pole 32, thermally exchanged, and recycled.

At this time, an ice pole is formed on the outer wall of the cooling pole 32 due to the cold air, and provides the cold air to the surroundings of the cooling pole 32, so that the user can feel refreshed through the outward appearance of the ice pole and the ice pole visually informs the user of that cool things are put on the cooling container 30.

Moreover, when the user turns off the lamp 84 mounted inside the shade 34, the lamp 84 throws light on the ice 10, the alcoholic liquor container 12 and the beverage container 14 contained in the cooling container 30 so as to produce the more bright atmosphere. As shown in FIG. 7, in the case where the transparent auxiliary plate 38 is mounted on the cooling pole 32, more gorgeous rainbow light can be produced due to diffused reflection and color separation by permeation of light and the transparent ice 10.

At this time, in the case where the lamp 84 has various colors, since the lamp 84 provides light of various colors, the user s visual satisfaction is increased more.

Meanwhile, in the case where the user keeps the cooler of table-type in safe after finishing the use or uses it as a table for putting something on the upper surface of the table 20, when the user presses the descent switch mounted on the switch panel 28, the cooling container 30, the cooling pole 32 and the shade 34 are all descended by the elevator 60, and contained into the chilling room 22. That is, as shown in FIGS. 1 to 3, in the case where the elevator 60 is the telescopic cylinder 62, the descending is carried out by shrinking of the piston rod. And, as shown in FIG. 8, in the case where the elevator 60 is the pantograph jack 90, when the lead screw 92 is rotated backwardly by the elevation motor 94, the upper end of the center of the pantograph jack 90 is shrunk downwardly, and then, the cooler 50 and the cooling container 30 are descended into the chilling room 22.

After that, the racks 74*a* and 74*b* and the sliding doors 76*a* and 76*b* are straightly moved in a horizontal direction by the pinions 72*a* and 72*b* rotated by the opening and closing motors 70*a* and 70*b*, and projected through the door entrances 22*a* and 22*b* formed at the upper portion of the inner wall of the chilling room 22, so that the chilling room 22 is closed.

Additionally, when the operation of the cooler 50 is stopped to wash the cooling container 30, some of the ice 10 filling the cooling container 30 is melted and changed into water or wash water used for washing remains in the cooling container 30. At this time, when the user removes a stopper stopping the rain pipe 36, water remaining in the cooling container 30 can be easily drained to the outside through the drain pipe 36.

The invention claimed is:

1. A cooler of table-type comprising:

a chilling room formed at the center of a table, opened at the top and closed at the inner periphery and the bottom;

a cooling container adapted to vertically elevate in a state where it is in tight contact with the inner periphery of the chilling room and adapted to contain foods such as fruits, beverage and alcoholic liquors within the cooling container;

a cooling pole vertically mounted on the bottom of the cooling container and adapted to form ice on the surface of the cooling pole;

a mushroom type shade mounted on the top of the cooling pole and covering the upper end of the chilling room when the mushroom type shade is descended, the shade having a predetermined thickness;

cooling coils arranged inside and outside the cooling container, the cooling pole and the shade for circulating refrigerant;

a cooler for thermally exchanging the refrigerant by circulating the refrigerant through the cooling coils and repeating condensation and expansion; an elevator for vertically elevating the cooling container; and a drain pipe mounted downwardly from the bottom of the cooling container.

2. A cooler of table-type according to claim 1, further comprising a fan mounted inside the shade.

3. A cooler of table-type according to claim 1, further comprising a fog discharge device mounted inside the shade.

4. A cooler of table-type according to claim 1, further comprising an illuminating system mounted inside the shade.

5. A cooler of table-type according to claim 1, further comprising a grill mounted on the lower surface of the shade for discharging the cold air and fogs and downwardly throwing a light.

6. A cooler of table-type according to claim 1, further comprising:

a grill mounted on the lower surface of the shade for discharging the cold air and fogs and downwardly emitting illumination;

a humidifier for generating fogs;

a fan for discharging the cold air and fogs; and a lamp for throwing a light.

7. A cooler of table-type according to claim 6, further comprising opening and closing means for covering the upper surface of the shade to allow a user to use the cooler as a general table which has an even upper surface.

8. A cooler of table-type according to claim 7, wherein the opening and closing means includes sliding doors for opening and closing the chilling room, the sliding doors horizontally moving by pinions and racks driven by opening and closing motors and moving into and out of the chilling room through slit type door entrances formed at the right and left sides of the top of the inner wall of the chilling room.

9. A cooler of table-type according to claim 1, further comprising opening and closing means for covering the upper surface of the shade to allow a user to use the cooler as a general table which has an even upper surface.

10. A cooler of table-type according to claim 9, wherein the opening and closing means includes sliding doors for opening and closing the chilling room, the sliding doors horizontally moving by pinions and racks driven by opening and closing motors and moving into and out of the chilling room through slit type door entrances formed at the right and left sides of the top of the inner wall of the chilling room.

11. A cooler of table-type according to claim 1, wherein the cooling coil mounted inside the cooling pole is arranged on the inner periphery of the cooling pole in a coil form, and has a return pipe mounted at the center of the cooling coil for returning the refrigerant.

12. A cooler of table-type according to claim 1, wherein the cooling coil mounted inside the cooling pole is bent in a zigzag form, rolled in an arc shape, in tight contact with the inner periphery of the cooling pole, and has a return pipe mounted at the center of the cooling coil for returning the refrigerant.

13. A cooler of table-type according to claim 1, further comprising at least one auxiliary plate placed at the center of the cooling pole for putting fruits, a beverage container or an alcoholic liquor container on the auxiliary plate.

14. A cooler of table-type according to claim 13, wherein the auxiliary plate has a cooling coil and a drain pipe.

15. A cooler of table-type according to claim 13, wherein the elevator includes at least one cylinder vertically mounted between the lower surface of the cooling container and the bottom of the chilling room in tight contact with them for elevating the cooling container by expansion and shrinkage.

16. A cooler of table-type according to claim 13, wherein the elevator includes:

a pantograph jack for connecting the lower surface of the cooling container and the bottom of the chilling room with each other;

pivot nuts mounted at right and left sides of a linking part of the pantograph jack and respectively having screw threads formed in opposite directions to each other;

a lead screw screwed to the pivot nuts for vertically expanding and shrinking the pantograph jack; and an elevation motor connected to a side end of the lead screw for rotating the lead screw.

17. A cooler of table-type according to claim 14, wherein the elevator includes at least one cylinder vertically mounted between the lower surface of the cooling container and the bottom of the chilling room in tight contact with them for elevating the cooling container by expansion and shrinkage.

18. A cooler of table-type according to claim 14, wherein the elevator includes:

a pantograph jack for connecting the lower surface of the cooling container and the bottom of the chilling room with each other;

pivot nuts mounted at right and left sides of a linking part of the pantograph jack and respectively having screw threads formed in opposite directions to each other;

a lead screw screwed to the pivot nuts for vertically expanding and shrinking the pantograph jack; and an elevation motor connected to a side end of the lead screw for rotating the lead screw.

19. A cooler of table-type according to claim 1, wherein the elevator includes at least one cylinder vertically mounted between the lower surface of the cooling container and the bottom of the chilling room in tight contact with them for elevating the cooling container by expansion and shrinkage.

20. A cooler of table-type according to claim 19, wherein the cylinder is a telescopic cylinder.

21. A cooler of table-type according to claim 1, wherein the elevator includes:

a pantograph jack for connecting the lower surface of the cooling container and the bottom of the chilling room with each other;

pivot nuts mounted at right and left sides of a linking part of the pantograph jack and respectively having screw threads formed in opposite directions to each other;

a lead screw screwed to the pivot nuts for vertically expanding and shrinking the pantograph jack; and an elevation motor connected to a side end of the lead screw for rotating the lead screw.

* * * * *